US011000074B2

(12) United States Patent
Qiu

(10) Patent No.: US 11,000,074 B2
(45) Date of Patent: May 11, 2021

(54) HEATING ASSEMBLY, ATOMIZING HEAD, ATOMIZER AND ELECTRONIC CIGARETTE THEREOF

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 357 days.

(21) Appl. No.: 16/225,686

(22) Filed: Dec. 19, 2018

(65) Prior Publication Data

US 2019/0124990 A1 May 2, 2019

Related U.S. Application Data

(63) Continuation of application No. PCT/CN2016/098529, filed on Sep. 9, 2016.

(30) Foreign Application Priority Data

Jun. 23, 2016 (CN) ..... 201610465536.X

(51) Int. Cl.
*F22B 1/28* (2006.01)
*A24F 47/00* (2020.01)

(52) U.S. Cl.
CPC ..... *A24F 47/008* (2013.01)

(58) Field of Classification Search
CPC ..... C23C 16/4481; F22B 1/282
USPC ..... 165/164; 392/450
See application file for complete search history.

(56) References Cited

U.S. PATENT DOCUMENTS 3,270,182 A * 8/1966 Hynes ..... F24H 3/0405 392/492
3,780,767 A * 12/1973 Borg ..... F16K 47/08 137/625.3
7,891,415 B2 * 2/2011 Ushio ..... F28F 1/105 165/146
9,982,341 B2 * 5/2018 Schoepp ..... C23C 16/4481
(Continued)

FOREIGN PATENT DOCUMENTS

CN 1205849 A 1/1999
CN 102076126 A 5/2011
(Continued)

*Primary Examiner* — Phuong Chi Thi Nguyen
(74) *Attorney, Agent, or Firm* — Novick, Kim & Lee, PLLC; Allen Xue

(57) ABSTRACT

A heating assembly, an atomizing head, an atomizer, and an electronic cigarette are disclosed. The heating assembly includes two or more laminated heating plates, each heating plate is provided with through hole(s) and/or through groove(s), the gap between the adjacent heating plates is capillary gap, the through hole and/or the through groove of the heating plates are at least partially in communication with the through hole and/or the through groove of the adjacent heating plates. The heating plate, the atomizing head, the atomizer, and the electronic cigarette of the present disclosure use the capillary gap between adjacent heating fins for liquid guiding. Compared with the conventional liquid guiding cotton or glass fiber, there is no odor, and there is no risk that the user in smoke the capillary fiber.

13 Claims, 5 Drawing Sheets

(56) References Cited

U.S. PATENT DOCUMENTS

| | | | | |
|---|---|---|---|---|
| 2015/0217068 | A1 | 8/2015 | Wakalopulos | |
| 2020/0113236 | A1* | 4/2020 | Qiu | A24F 40/49 |
| 2020/0345074 | A1* | 11/2020 | Ding | A24F 40/46 |

FOREIGN PATENT DOCUMENTS

| | | | |
|---|---|---|---|
| CN | 203407518 | U | 1/2014 |
| CN | 103781375 | A | 5/2014 |
| CN | 203575654 | U | 5/2014 |
| CN | 103929989 | A | 7/2014 |
| CN | 204377931 | U | 6/2015 |
| CN | 205848690 | U | 1/2017 |
| CN | 105394815 | B | 8/2018 |
| CN | 105433447 | B | 8/2018 |
| WO | 2015114328 | A1 | 8/2015 |

* cited by examiner

HEATING ASSEMBLY, ATOMIZING HEAD, ATOMIZER AND ELECTRONIC CIGARETTE THEREOF

CROSS-REFERENCE TO RELATED APPLICATIONS

This application is a continuation of International Patent Application No. PCT/CN2016/098529, filed on Sep. 9, 2016, entitled "heating assembly, atomizing head, atomizer and electronic cigarette thereof", which claims priority to Chinese Patent Application No. 201610465536.X, filed on Jun. 23, 2016, entitled "heating assembly, atomizing head, atomizer and electronic cigarette thereof". All of the aforementioned patent applications are hereby incorporated by reference in their entireties.

FIELD OF TECHNOLOGY

The present disclosure relates to the field of electronic cigarette technology, and more particularly to a heating assembly, an atomizing head, an atomizer and an electronic cigarette using the same.

BACKGROUND

At present, the heating assembly of electronic cigarettes usually use liquid cotton, glass fiber or liquid-conducting ceramic to guide cigarette liquid. However, at high temperatures, both the liquid guiding cotton and the glass fiber are easily scorched, a small amount of flue gas generated after being scorched affect the taste of the electronic cigarette. On the other hand, the liquid guide cotton and the glass fiber easily release the capillary fibers, which may be inhaled into the human body during smoking, causing damage to the user's body. In the preparation process, the pore-forming ceramics usually use pore-forming agents to make pores, the residual pore-forming agent of ceramics may precipitate harmful substances at high temperatures, which may cause certain harm to the user's body.

SUMMARY

In view of at least one of the above technical problems, an object of the present disclosure provides a heating assembly, an atomizing head, an atomizer, and an electronic cigarette.

A heating assembly for an electronic cigarette includes two or more laminated heating plates, each heating plate is provided with through hole(s) and/or through groove(s), the gap between the adjacent heating plates is capillary gap, the through hole and/or the through groove of the heating plates are at least partially in communication with the through hole and/or the through groove of the adjacent heating plates.

In one embodiment, the surface roughness Ra of the heating plates is 2.5 μm≤Ra≤40 μm.

In one embodiment, the thickness of the heating plate is 0.1 mm≤d≤3 mm.

In one embodiment, the heating plate is made of metal.

In one embodiment, the heating plate is made of at least one material selected from iron chromium aluminum alloy, nickel chromium alloy, stainless steel, nickel, titanium, iron, copper, and tungsten.

In one embodiment, some of the through holes in the heating plate are capillary through holes, and/or some of the through grooves of the heating plate are capillary through grooves.

An atomizing head, for an electronic cigarette, the atomizing head includes any one of the above heating assemblies.

In one embodiment, the surface roughness Ra of the heating plates is 2.5 μm≤Ra≤40 μm.

In one embodiment, the thickness of the heating plate is 0.1 mm≤d≤3 mm.

In one embodiment, the heating plate is made of metal.

In one embodiment, the heating plate is made of at least one material selected from iron chromium aluminum alloy, nickel chromium alloy, stainless steel, nickel, titanium, iron, copper, and tungsten.

In one embodiment, some of the through holes of the heating plate are capillary through holes and/or some of the through grooves of the heating plate are capillary through grooves.

In one embodiment, the atomizing head comprises an atomizing head base, an atomizing head sleeve, a heating assembly, an atomizing head electrode contact, and an atomizing head insulating ring, the atomizing head sleeve is a hollow structure opens at both ends, the atomizing head base is sealed and abuts against one end of the atomizing head sleeve, and the other end of the atomizing head sleeve opposite to the atomizing head base is an open end, the upper surface of the atomizing head base and the inner surface of the atomizing head sleeve cooperatively define an atomizing chamber, the heating assembly is received in the atomizing chamber and is supported by the atomizing head base, the atomizing head base is further provided with a receiving hole extending through the two opposite ends of the atomizing head base, the atomizing head electrode contact is housed in the receiving hole, the atomizing head insulating ring is disposed between the atomizing head electrode contact and the receiving hole, the inlet wall of the atomizing head sleeve is provided with a liquid inlet hole.

In one embodiment, the atomizing head further includes a gland, the gland is disposed on the topmost heating plate, the gland is provided with gland openings, the gland openings are in communication with some of the through holes and/or the through grooves of the topmost heating plate.

An atomizer for an electronic cigarette includes any one of the above heating assemblies.

In one embodiment, the surface roughness Ra of the heating plates is 2.5 μm≤Ra≤40 μm.

In one embodiment, the thickness of the heating plate is 0.1 mm≤d≤3 mm.

In one embodiment, the heating plate is made of metal.

In one embodiment, the heating plate is made of at least one material selected from iron chromium aluminum alloy, nickel chromium alloy, stainless steel, nickel, titanium, iron, copper, and tungsten.

In one embodiment, some of the through holes of the heating plate are capillary through holes and/or some of the through groove of the heating plates are capillary through grooves.

In one embodiment, the atomizer includes a liquid storage assembly, an atomizing head, a liquid injection assembly, a ventilation assembly, and a mouthpiece assembly, the liquid storage assembly has a closed end and an open end, the atomizing head is received in the liquid storage assembly, the liquid injection assembly is coupled with the open end of the liquid storage assembly, one end of the ventilation assembly is pass through the liquid injection assembly and connected to the atomizing head, the ventilation assembly is in communication with the atomizing head.

An electronic cigarette includes any one of the above atomizer and a battery device electrically connected to the atomizer for powering.

In one embodiment, the surface roughness Ra of the heating plates is 2.5 μm≤Ra≤40 μm.

In one embodiment, the thickness of the heating plate is 0.1 mm≤d≤3 mm.

In one embodiment, the heating plate is made of metal.

In one embodiment, the heating plate is made of at least one of iron chromium aluminum alloy, nickel chromium alloy, stainless steel, nickel, titanium, iron, copper, and tungsten.

In one embodiment, some of the through holes of the heating plate are capillary through holes, and/or some of the through grooves of the heating plate are capillary through grooves.

The beneficial effects of the device are:

The heating plate, the atomizing head, the atomizer, and the electronic cigarette of the present disclosure use the capillary gap between adjacent heating fins for liquid guiding. Compared with the conventional liquid guiding cotton or glass fiber, there is no odor, and there is no risk that the user inhales the capillary fiber.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION OF PREFERRED EMBODIMENTS

The specific embodiments of the present disclosure will be described in detail below with reference to the accompanying drawings. It should be understood that the specific embodiments described herein are only used to illustrate and explain the present disclosure and are not intended to limit the present disclosure.

Figure 1:
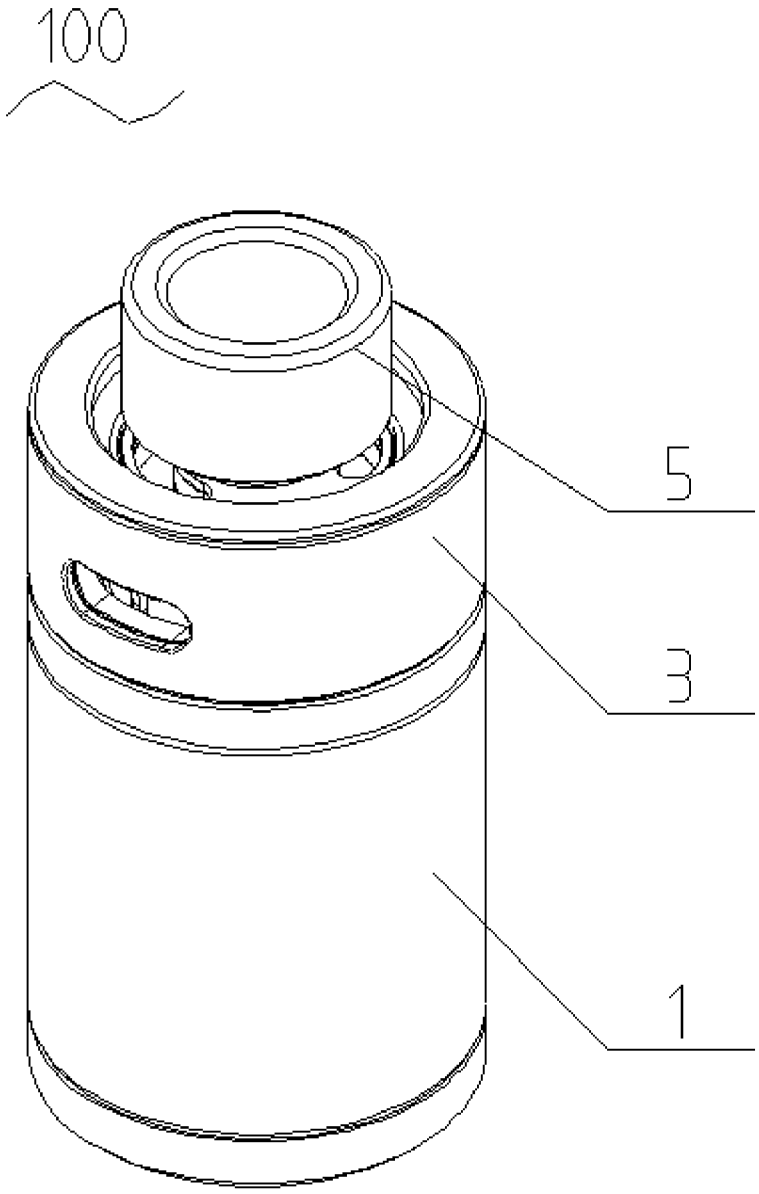
FIG. 1 is a perspective view of an atomizer according to the present application.
Figure 2:
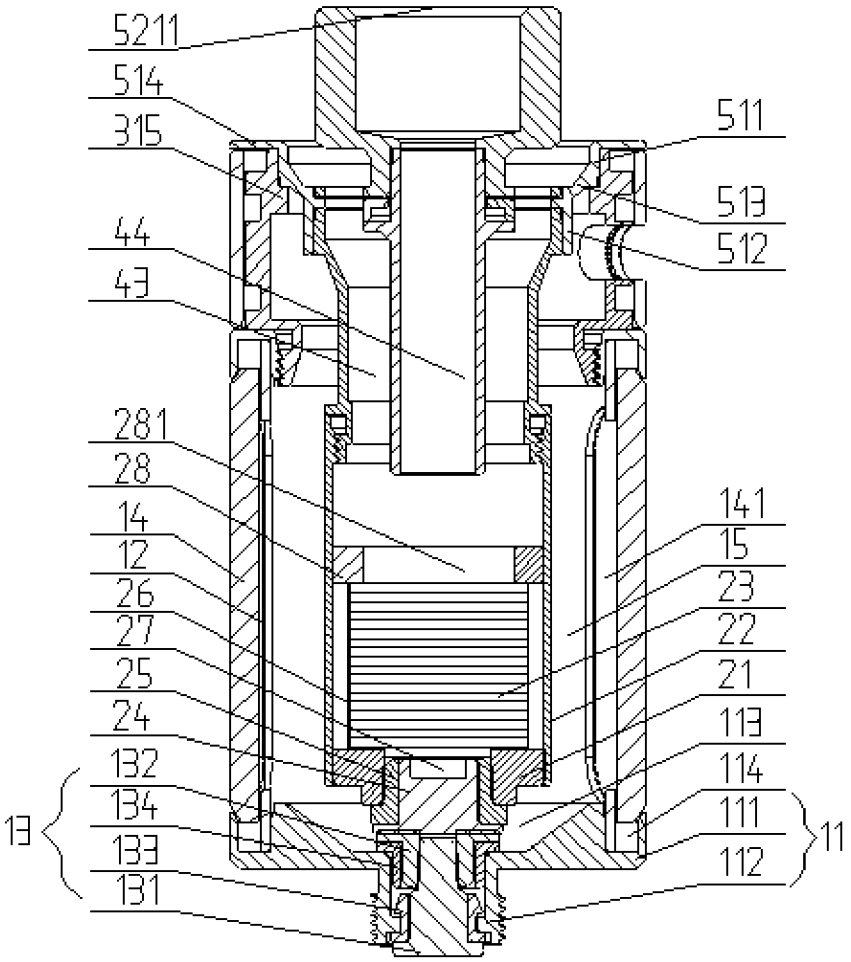
FIG. 2 is a cross-sectional view of the atomizer of FIG. 1.
Figure 3:
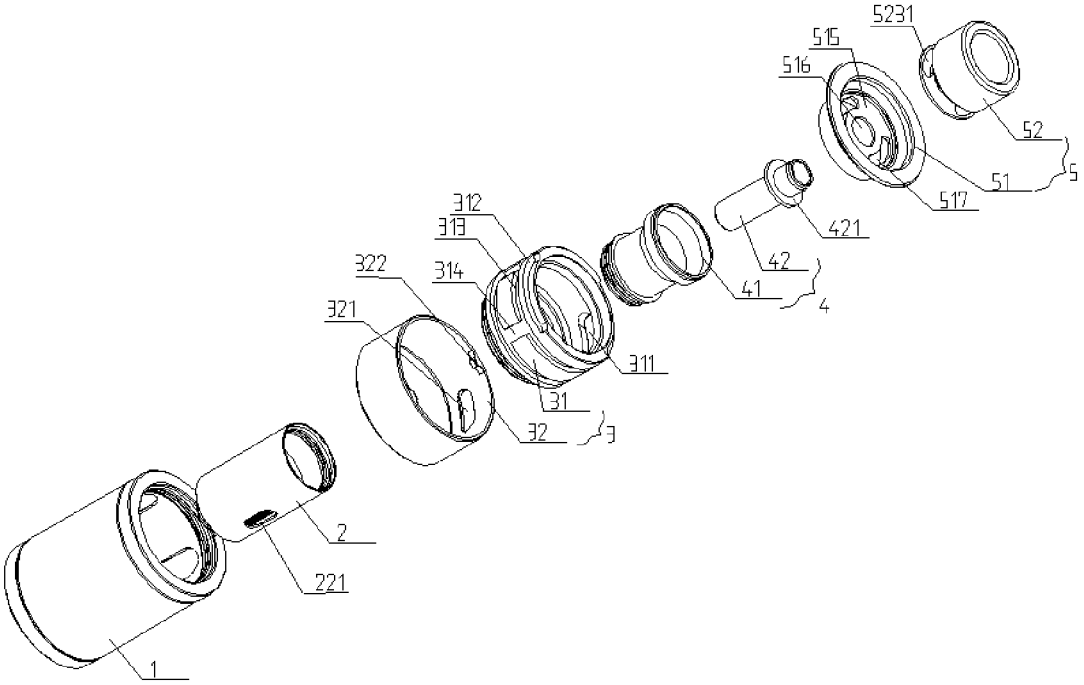
FIG. 3 is an exploded view of the atomizer of FIG. 1.

Referring to FIG. 1 to FIG. 3, the present disclosure provides an electronic cigarette (not shown). The electronic cigarette includes an atomizer 100 and a battery device (not shown). The battery device is electrically connected to the atomizer 100 for powering the atomizer 100. The atomizer 100 is configured for atomizing the cigarette liquid stored therein to generate smoke for use to inhale.

Specifically, the atomizer 100 includes a liquid storage assembly 1, an atomizing head 2, a liquid injection assembly 3, a ventilation assembly 4, and a mouthpiece assembly 5. The liquid storage assembly 1 has a closed end and an opposite open end. The atomizing head 2 is housed in the liquid storage assembly 1. The liquid injection assembly 3 is deposed at the open end of the liquid storage assembly 1 and in communication with the liquid storage assembly 1. One end of the ventilation assembly 4 passes through the liquid injection assembly 3 and is connected to the atomizing head 2. The opposite end of the ventilation assembly 4 is connected to and in communication with the mouthpiece assembly 5. The cigarette liquid is injected into the liquid storage assembly 1 through the liquid injection assembly 3. The atomizing head 2 atomizes the cigarette liquid stored in the liquid storage assembly 1 to generate smoke, the smoke flows through the ventilation assembly 4, and finally, it flows out of the mouthpiece assembly 5 for the user to inhale.

Specifically, the liquid storage assembly 1 includes a base 11, a liquid storage tube 12, and an electrode contact assembly 13. The base 11 includes a cover bottom plate 111 and a tube 112. The upper surface of the cover bottom plate 111 is recessed inwardly to form a receiving cavity 113. Especially, the receiving cavity 113 is defined at the center of the upper surface of the cover bottom plate 111. A groove 114 is defined between the upper surface edge of the cover bottom plate 111 and the receiving cavity 113. The tube 112 passes through the cover bottom plate 111 and is in communication with the receiving cavity 113. In the embodiment, the tube 112 is disposed at the center of the lower surface of the cover bottom plate 111. The liquid storage tube 12 is a hollow structure that opens at both ends, the bottom end the liquid storage tube 12 is embedded in the groove 114. The electrode contact assembly 13 is disposed in the tube 112. The electrode contact assembly 13 includes a first positive electrode contact 131, a second positive electrode contact 132, a first insulating ring 133, and a second insulating ring 134. The first positive electrode contact 131 is located in the tube 112 and is insulated from the tube wall of the tube 112 by the first insulating ring 133. The second positive electrode contact 132 is sleeved on the top end of the first positive electrode contact 131 and is insulated from the tube wall of tube 112 by the second insulating ring.

Further, the liquid storage assembly 1 further includes a window tube 14. The window tube 14 is sleeved on the outer circumference of the liquid storage tube 12, the bottom end of the window tube 14 is embedded in the groove 114 together with the bottom end of the liquid storage tube 12. The liquid storage tube 12 is made of transparent material, such as glass. The window tube 14 is made of hard material such as stainless steel, for protecting the liquid storage tube 12. A window 141 is defined on the window tube 14 for the user to observe the remaining amount of the cigarette liquid.

Specifically, the atomizing head 2 includes an atomizing head base 21, an atomizing head sleeve 22, a heating assembly 23, an atomizing head electrode contact 24, and an atomizing head insulating ring 25. The atomizing head sleeve 22 is a hollow structure that opens at both ends. The atomizing head base 21 is sealed and abuts against one end of the atomizing head sleeve 22, the other end of the atomizing head sleeve 22 opposite to the atomizing head base 21 is an open end. The upper surface of the atomizing head base 21 and the inner surface of the atomizing head sleeve 22 cooperatively define an atomization chamber 26. The heating assembly 23 is received in the atomization chamber 26 and is supported by the atomizing head base 21. The atomizing head base 21 is further provided with a receiving hole 27 extending through the opposite two ends of the atomizing head base 21. The atomizing head electrode contact 24 is housed in the receiving hole 27, one end of the atomizing head electrode contact 24 is electrically connected to the heating assembly 23, the opposite end of the atomizing head electrode contact 24 is electrically connected to the electrode contact component 13. The atomizing head insulating ring 25 is disposed between the atomizing head electrode contact 24 and the receiving hole 27, thereby the atomizing head electrode contact 24 is insulated from the wall of the receiving hole 27. In the embodiment, the atomizing head electrode contact 24 functions as the positive electrode contact of the atomizing head 2, the atomizing head base 21 and the atomizing head sleeve 22 are made of conductive material and both function as negative contact of the atomizing head 2. The atomizing head 2 is housed in the liquid storage tube 12, the atomizing head 2 is entirely supported by the atomizing head electrode contact 24 on the electrode contact assembly 13. Thereby the upper surface of the base 11, the inner surface of the liquid storage tube 12, and the outer peripheral surface of the atomizing head 2 collectively define a reservoir chamber 15 for storing the cigarette liquid. The inlet wall of the atomizing head sleeve 22 is provided with a liquid inlet hole 221 in communication between the liquid storage chamber 15 and the atomization chamber 26.

Figure 4:
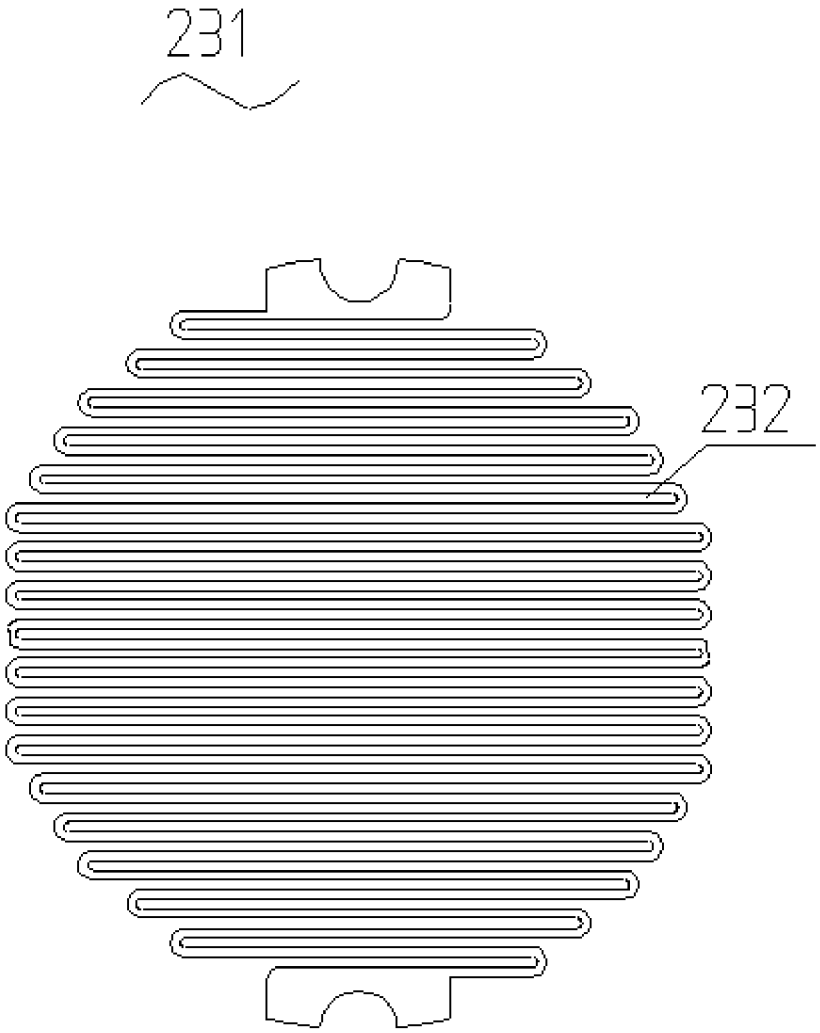
FIG. 4 is a perspective view of the heating plate of the heating assembly of FIG. 2.

Referring to FIG. 4, the heating assembly 23 is formed by laminating two or more heating plates 231 having through holes (not shown) and/or through grooves 232. The gap between the adjacent heating plates 231 is capillary gap, some of the through holes and/or the through grooves 232 of the heating plates 231 are in communication with the through holes and/or the through grooves 232 of the adjacent heating plates 231. Thereby, the cigarette liquid flowing into the atomization chamber 26 from the liquid inlet hole 221 is guided to the corresponding heating plate 231 under the capillary action of the capillary gap, the corresponding heating plate 231 heats the cigarette liquid under electric driving to generate smoke. When the user inhales, the smoke flows upward from the communication passage located between the through holes and/or the through grooves of the adjacent heating plates 231, to the through holes and/or the through grooves 232 of the heating plates 231 located at the top of the heating assembly 23, and to the open end of the atomizing head sleeve 22. It can be understood that, when the user inhales, the cigarette liquid can also flow upward through the through hole of the adjacent heating piece 231 and/or the through grooves 232, so that the cigarette liquid can further infiltrate the heating plates 231, thereby the possibility of dry burning of the heating plates 231 is reduced.

Figure 5:
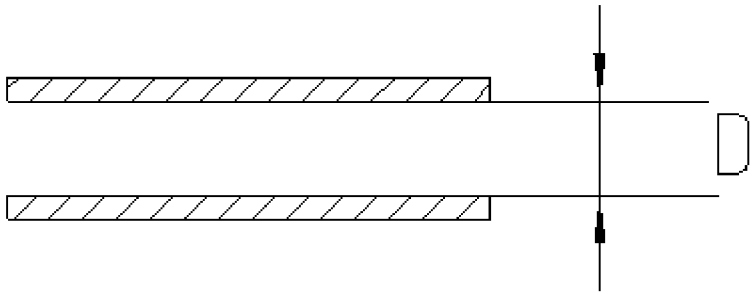
FIG. 5 is a cross-sectional view of two adjacent heating plates of the heating assembly of FIG. 2.

Referring to FIG. 5 in combination, the gap between adjacent heating plates 231 is a capillary gap, that is the distance D between adjacent heating plates 231 is $0<D\leq 1$ mm. In order to make the gap between the adjacent heating plates 231 is the capillary gap, in one embodiment, the surface roughness Ra of the heating plates 231 is 2.5 $\mu m\leq Ra\leq 40$ $\mu m$. The heating plates 231 can be processed by at least one of the following processes: turning, rough grinding, fine grinding, planning, milling, and laser micro-engraving, thereby to get the heating plates 231 having a surface roughness Ra of 2.5 $\mu m\leq Ra\leq 40$ $\mu m$. The thickness of the heating plates is 0.1 $mm\leq d\leq 3$ mm. The heating plate 231 is a metal heating plate made of at least one material selected from iron chromium aluminum alloy, nickel chromium alloy, stainless steel, nickel, titanium, iron, copper, and tungsten. Since the heating plate 231 is a metal heating plates having a thickness of 0.1 to 3 mm, the heating plate 231 is easily processed to form a through hole and/or a through grooves 232. The through holes and/or the through grooves 232 of the heating plate 231 are processed by at least one of the following processes: stamping, fast wire cutting, slow wire cutting, wire cutting, laser cutting, chemical etching, and photo etching.

Further, some of the through holes of the heating plate 231 are capillary through holes, and/or some of the through grooves of the heating plate 231 are capillary through grooves. The capillary through hole and the capillary through groove can store cigarette liquid, so that the heating plate 231 can keep sufficiently wet to prevent the heating plate 231 from being dry and affecting the user's suction taste.

Further, the atomizing head 2 further includes a gland 28. The gland 28 is disposed on the heating plate 231 located at the top of the heating assembly 23 for pressing the heating plate 231 to prevent the heating plates 231 from swaying and loosening. Gland openings 281 are defined on the gland 28, the gland openings 281 are in communication with one or more of the through hole(s) and/or the through groove(s) 232 of the heating plate 231 located at the top of the heating assembly 23.

Specifically, the liquid injection assembly 3 includes an inner ring cover 31 and an outer ring cover 32. The inner ring cover 31 is detachably covered at the top end of the liquid storage tube 12, the outer ring cover 32 is rotatably sleeved on the outer circumference of the inner ring cover 31. The inner ring cover 31 is provided with a first liquid injection hole 311 in communication with the liquid storage chamber 15. The outer ring cover 32 is provided with a second liquid injection hole 321. Rotating the outer ring cover 32 can make the first liquid injection hole 311 to communicate with or be staggered from the second liquid injection hole 321. When injecting cigarette liquid, the outer ring cover 32 can be rotated to make the second liquid injection hole 321 in communication with the first liquid injection hole 311, and then the cigarette liquid is injected into the liquid storage chamber 15 through the second liquid injection hole 321 and the first liquid injection hole 311. When the injecting is completed, the outer ring cover 32 is rotated to make the second liquid injection hole 321 staggered from the first liquid injection hole 311, then the first liquid injection hole 311 is blocked by the annular wall of the outer ring cover 32. Thereby the user can inject cigarette liquid without disassembling the inner ring cover 31, which can make the liquid injection more simple and convenient. In the embodiment, the first liquid injection hole 311 is circumferentially defined on the inner wall of the inner ring cover 31, the second liquid injection hole 321 is circumferentially defined on the outer ring cover 32.

Further, the inner ring cover 31 is provided with a sliding slot 312. In the embodiment, the sliding slot 312 is located along the edge of the top surface of the inner ring cover 31. The top end of the inner circumferential surface of the outer ring cover 32 is provided with a protrusion 322. When the outer ring cover 32 is rotating around the inner ring cover 31, the protrusion 322 cooperates with the sliding slot 312, and then the projections 322 can be stopped by the groove walls at both ends of the sliding slot 312, thereby limiting the rotational travel of the outer ring cover 32.

Further, both ends of the outer circumferential surface of the inner ring cover 31 are provided a seal ring groove 313 along the circumferentially of the inner ring cover 31. The outer circumferential surface of the inner ring cover 31 is provided with sealing grooves 314 disposed along the axial direction of the inner ring cover 31. The sealing grooves 314 are spaced apart from each other. A sealing member is disposed in the seal ring groove 313 and the sealing groove 314 (not shown). The sealing member may be a silicone ring or the like. The sealing member causes the inner ring cover 31 to closely cooperate with the outer ring cover 32, to prevent the smoke liquid from flowing out of the gap between the inner ring cover 31 and the outer ring cover 32. On the other hand, the sealing member increases the frictional force between the outer circumferential surface of the inner ring cover 31 and the inner circumferential surface of the outer ring cover 32 so as to prevent the outer ring cover 32 from rotating arbitrarily with respect to the inner ring cover 31.

Specifically, the ventilating assembly 4 includes an atomizing tube 41 and a vent tube 42, both of which has a hollow structure opens at both ends. One end of the atomizing tube 41 is detachably connected to the open end of the atomizing head sleeve 22, the opposite end extends into the inner cavity of the inner ring cover 31. The vent tube 42 is sleeved in the atomizing tube 41, the outer diameter of the vent tube 42 is smaller than the inner diameter of the atomizing tube 41. Thus, the inner surface of the atomizing tube 41 and the outer surface of the vent tube 42 define an intake passage 43, the inner cavity of the vent tube 42 constitutes a smoke outlet passage 44. The intake passage 43 and the outlet passage 44 are communication with the open end of the atomizing head sleeve 22. The outside air flows into the open end of the atomizing head sleeve 22 via the intake passage 43, mixes with the formed smoke, and then flows out of the smoke outlet passage 44.

Specifically, the mouthpiece assembly 5 includes a mouthpiece connector 51 and a mouthpiece 52. The mouthpiece connector 51 includes a cover plate 511, a connecting board 513, and a connection pipe 512. The cover plate 511 and the connection pipe 512 are connected together through the connecting board 513. The connecting board 513 is located between the cover plate 511 and the connecting tube 512 and is inclined toward the connecting tube 512. The radial dimension of the cover plate 511, the connecting board 513 and the connecting tube 512 are gradually reduced so that the mouthpiece connector 51 has a funnel-like structure. A flange 514 extends outwardly from the circumferential side of the cover plate 511. The flange 514 abuts against one end of the inner ring cover 31 opposite to the liquid storage tube 12. The cover plate 511 and the connecting tube 512 extend into the cavity of the inner ring cover 31. A boss 315 is protruded from the inner circumferential surface of the inner ring cover 31. The cover plate 511 is supported on the boss 315, the connecting tube 512 is interference-fitted with one end of the atomizing head sleeve 22 opposite to the atomizing tube 41. The end surface of one end of the cover plate 511 away from the connecting tube 512 is recessed to the bottom surface of the connecting board 513 to form a receiving groove 515. A central hole 516 is defined in a center of the bottom wall of the receiving groove 515 (i.e., the bottom surface of the connecting board 513). The bottom wall of the receiving groove 515 defines an air inlet hole 517 surrounding the central hole 516 and is in communication with the air intake passage 43. The vent tube 42 provides an abutting edge 421 extending outwardly from the circumferential side opposite to one end of the atomizing head sleeve 22. When one end of the vent tube 42 away from the atomizing head sleeve 22 passes through the center hole 516, the abutting edge 421 abuts against the lower side of the bottom wall of the receiving groove 515.

Figure 6:
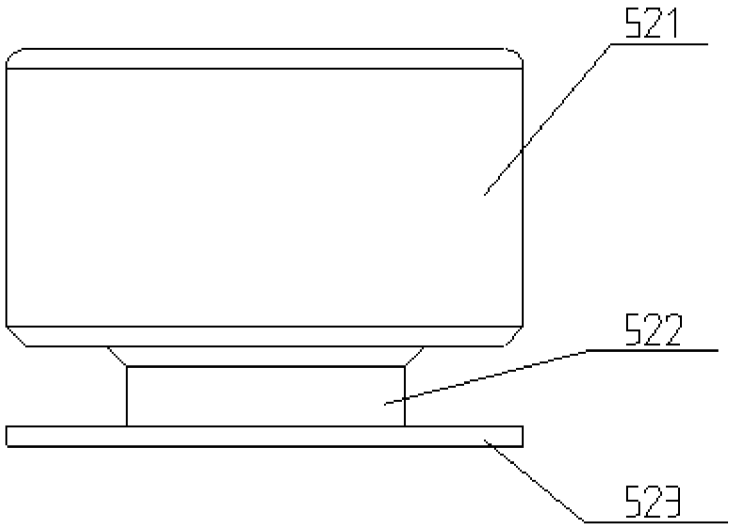
FIG. 6 is a front view of the mouthpiece shown in FIG. 1.

Referring to FIG. 6, the mouthpiece 52 includes a sucking section 521, a connecting section 522, and a support plate 523, the sucking section 521 and the support plate 523 are connected by a connecting section 522.

The support plate 523 is supported on the upper side of the bottom wall of the receiving groove 515. The connecting section 522 is sleeved over the outer circumference of the end of the vent tube 42 passing through the center hole 516. The sucking section 521 is provided with a vent 5211 in communication with the smoke outlet passage 44.

Thereby, the outside air flows into the atomizer 100 via the air inlet hole 517 and the intake passage 43 successively, and mixed with smoke at the open end of the atomizing head sleeve 22, and then flows through the outlet passage 44, and finally flows out of the sucking section 521 via the vent 5211.

Further, in order to facilitate the adjustment of the amount of the intake air, the support plate 523 is provided with an air vent 5231, the connecting section 522 is circumferentially rotatable around the central axis of the mouthpiece connector 51. Thereby, the air vent 5231 can be in communication with or be staggered from the air inlet hole 517 to adjust the amount of intake air.

The heating assembly 23, the atomizing head 2, the atomizer 100, and the electronic cigarette of the present disclosure uses the capillary gap between adjacent heating plates 231 for liquid guiding. Compared with the conventional liquid guiding cotton or glass fiber, there is no odor, and there is no risk that the user inhales the capillary fiber during suction.

Further, since the heating plate 231 is a metal heating plate. Compared with the existing liquid-conducting ceramics, no residual pore-forming agent is generated during the atomizing process, thereby avoiding the possibility of harm to the human body.

The cigarette holder assembly 5 has a function of adjusting inlet addition to the function of suction by the user, so that the atomizer 100 and the electronic cigarette including the atomizer 100 do not need to be separately provided with an adjusting component, which simplifies the structure of the atomizer 100 and reduces production cost.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A heating assembly for an electronic cigarette comprising: two or more laminated heating plates, each heating plate is provided with through hole(s) and/or through groove(s), the gap between the adjacent heating plates is capillary gap, the through hole and/or the through groove of the heating plates are at least partially in communication with the through hole and/or the through groove of the adjacent heating plates;

wherein the heating plate is made of metal;

wherein the thickness of the heating plate is 0.1 mm sS d sS 3 mm.

2. The heating assembly according to claim 1, wherein the surface roughness Ra of the heating plates is 2.5 pm Ra 40 pm.

3. The heating assembly according to claim 1, wherein the heating plate is made of at least one material selected from iron chromium aluminum alloy, nickel chromium alloy, stainless steel, nickel, titanium, iron, copper, and tungsten.

4. The heating assembly according to claim 1, wherein some of the through holes of the heating plate are capillary through holes, and/or some of the through grooves of the heating plate are capillary through grooves.

5. An atomizing head, for an electronic cigarette, wherein the atomizing head comprises a heating assembly, the heating assembly comprises two or more laminated heating plates, each heating plate is provided with through hole(s) and/or through groove(s), the gap between the adjacent heating plates is capillary gap, the through hole and/or the through groove of the heating plates are at least partially in communication with the through hole and/or the through groove of the adjacent heating plates;

wherein the heating plate is made of metal;

wherein the surface roughness Ra of the heating plates is 2.5 pm sS Ra sS 40 pm.

6. The atomizing head according to claim 5, wherein the thickness of the heating plate is 0.1 mm sS d sS 3 mm.

7. The atomizing head according to claim 6, wherein the heating plate is made of at least one material selected from iron chromium aluminum alloy, nickel chromium alloy, stainless steel, nickel, titanium, iron, copper, and tungsten.

8. The atomizing head according to claim 6, wherein the atomizing head comprises an atomizing head base, an atomizing head sleeve, a heating assembly, an atomizing head electrode contact, and an atomizing head insulating ring; the atomizing head sleeve is a hollow structure opens at both ends, the atomizing head base is sealed and abuts against one end of the atomizing head sleeve, and the other end of the atomizing head sleeve opposite to the atomizing head base is an open end, the upper surface of the atomizing head base and the inner surface of the atomizing head sleeve cooperatively define an atomizing chamber, the heating assembly is received in the atomizing chamber and is supported by the atomizing head base, the atomizing head base is further provided with a receiving hole extending through the two opposite ends of the atomizing head base, the atomizing head electrode contact is housed in the receiving hole, the atomizing head insulating ring is disposed between the atomizing head electrode contact and the receiving hole, the inlet wall of the atomizing head sleeve is provided with a liquid inlet hole.

9. The atomizing head according to claim 8, wherein the atomizing head further comprises a gland, the gland is disposed on the topmost heating plate, the gland is provided with gland openings, the gland openings are in communication with some of the through holes and/or the through grooves of the topmost heating plate.

10. An atomizer for an electronic cigarette, wherein the atomizer comprises an atomizing head, the atomizing head comprises a heating assembly, the heating assembly comprises two or more laminated heating plates, each heating plate is provided with through hole(s) and/or through groove(s), the gap between the adjacent heating plates is capillary gap, the through hole and/or the through groove of the heating plates are at least partially in communication with the through hole and/or the through groove of the adjacent heating plates;

wherein the heating plate is made of metal;

wherein the thickness of the heating plate is 0.1 mm sS d sS 3 mm.

11. The atomizer according to claim 10, wherein the surface roughness Ra of the heating plates is 2.5 pm Ra 40 pm.

12. The atomizer according to claim 10, wherein the heating plate is made of at least one material selected from iron chromium aluminum alloy, nickel chromium alloy, stainless steel, nickel, titanium, iron, copper, and tungsten.

13. An electronic cigarette, comprising:

an atomizer, the atomizer comprises an atomizing head, wherein the atomizing head comprises a heating assembly, the heating assembly comprises two or more laminated heating plates, each heating plate is provided with through hole(s) and/or through groove(s), the gap between the adjacent heating plates is capillary gap, the through hole and/or the through groove of the heating plates are at least partially in communication with the through hole and/or the through groove of the adjacent heating plates; and a battery device, the battery device is electrically connected to the atomizer for powering the atomizer;

wherein the atomizer comprises a liquid storage assembly, an atomizing head, a liquid injection assembly, a ventilation assembly, and a mouthpiece assembly, the liquid storage assembly has a closed end and an open end, the atomizing head is received in the liquid storage assembly, the liquid injection assembly is coupled with the open end of the liquid storage assembly, one end of the ventilation assembly is pass through the liquid injection assembly and is connected to the atomizing head, the ventilation assembly is in communication with the atomizing head.

* * * * *